US011026034B2

(12) United States Patent
Kannan et al.

(10) Patent No.: US 11,026,034 B2
(45) Date of Patent: Jun. 1, 2021

(54) SYSTEM AND METHOD FOR SELF-CALIBRATING AUDIO LISTENING DEVICES

(71) Applicant: Google LLC, Mountain View, CA (US)

(72) Inventors: Govind Kannan, Irvine, CA (US); Wensen Liu, Irvine, CA (US); Jayvon Timmons, Irvine, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 16/664,728

(22) Filed: Oct. 25, 2019

(65) Prior Publication Data

US 2021/0127221 A1 Apr. 29, 2021

(51) Int. Cl.

| | |
|---|---|
| ***H04R 3/04*** | (2006.01) |
| ***H04R 29/00*** | (2006.01) |
| ***H04R 1/10*** | (2006.01) |

(52) U.S. Cl.

CPC ..... *H04R 29/001* (2013.01); *H04R 1/1041* (2013.01); *H04R 3/04* (2013.01); *H04R 2460/01* (2013.01)

(58) Field of Classification Search

CPC .... H04R 25/70; H04R 25/75; H04R 2225/39; H04R 2225/41; H04R 1/1025; H04R 25/30; H04R 29/001; H04R 29/004

USPC ..... 381/58, 60

See application file for complete search history.

(56) References Cited

U.S. PATENT DOCUMENTS

| | | | | |
|---|---|---|---|---|
| 10,764,699 | B1 * | 9/2020 | Rule | H04R 1/02 |
| 2017/0094381 | A1 * | 3/2017 | LeBlanc | H04R 1/345 |
| 2017/0245045 | A1 * | 8/2017 | Horbach | G10K 11/17821 |

* cited by examiner

*Primary Examiner* — Vivian C Chin
*Assistant Examiner* — Friedrich Fahnert
(74) *Attorney, Agent, or Firm* — Lerner, David, Littenberg, Krumholz & Mentlik, LLP

(57) ABSTRACT

A self-calibration system may include a housing including a first calibration circuit configured to coordinate with a second calibration circuit to execute a calibration sequence for an active noise cancelling (ANC) earphone. The housing further includes a cavity configured to accommodate the ANC earphone, wherein the cavity is contoured to simulate the ANC earphone in a user's ear. The housing further includes a calibration microphone coupled with the first calibration circuit and configured to measure calibration sound waves from the ANC earphone, and a calibration speaker configured to emit calibration sound waves to the ANC earphone.

20 Claims, 12 Drawing Sheets

SYSTEM AND METHOD FOR SELF-CALIBRATING AUDIO LISTENING DEVICES

TECHNICAL FIELD

The present disclosure generally relates to audio listening devices. More particularly, for example, it relates to systems and methods for self-calibrating audio listening devices.

BACKGROUND

Personal listening devices such as headphones, earphones, and headsets are calibrated during manufacturing at the production line to ensure such devices meet design specifications such as frequency responses, total harmonic distortion, uplink and down link noise reductions, and so forth. Audio devices with noise cancelling capabilities rely on the performance of embedded speakers and microphones to produce high quality noise cancellation. These audio devices can undergo changes during their lifespan, thus shifting the original specifications and affecting the user's listening experiences over time. The one-time calibration that is performed during production does not sufficiently ensure audio quality over an extended period. Thus, improved techniques for maintaining audio quality over the life of an audio device are desirable.

SUMMARY

Systems and methods providing improved calibration over the life of audio listening devices are disclosed herein. According to one or more embodiments, a system includes a housing including a first calibration circuit configured to coordinate with a second calibration circuit of an active noise cancelling (ANC) earphone to execute a calibration sequence for the earphone. The housing may further include a cavity configured to accommodate the ANC earphone, wherein the cavity is contoured to simulate the ANC earphone in a user's ear, a calibration microphone coupled with the first calibration circuit and configured to measure calibration sound waves from the ANC earphone, and a calibration speaker configured to emit calibration sound waves to the ANC earphone.

In various embodiments, a method for calibrating an active noise cancelling (ANC) earphone includes pairing a second calibration circuit of the ANC earphone with a first calibration circuit of a housing, and executing, by the second calibration circuit in communication with the first calibration circuit, a calibration sequence on the ANC earphone. The housing may include a first calibration circuit configured to coordinate with the second calibration circuit to execute a calibration sequence, a calibration microphone coupled with the first calibration circuit and configured to capture calibration sound waves from the ANC earphone, and a calibration speaker configured to emit calibration sound waves to the ANC earphone.

The scope of the invention is defined by the claims, which are incorporated into this section by reference. A more complete understanding of various embodiments will be afforded to those skilled in the art, as well as a realization of additional advantages thereof, by a consideration of the following detailed description. Reference will be made to the appended sheets of drawings that will first be described briefly.

Figure 1:
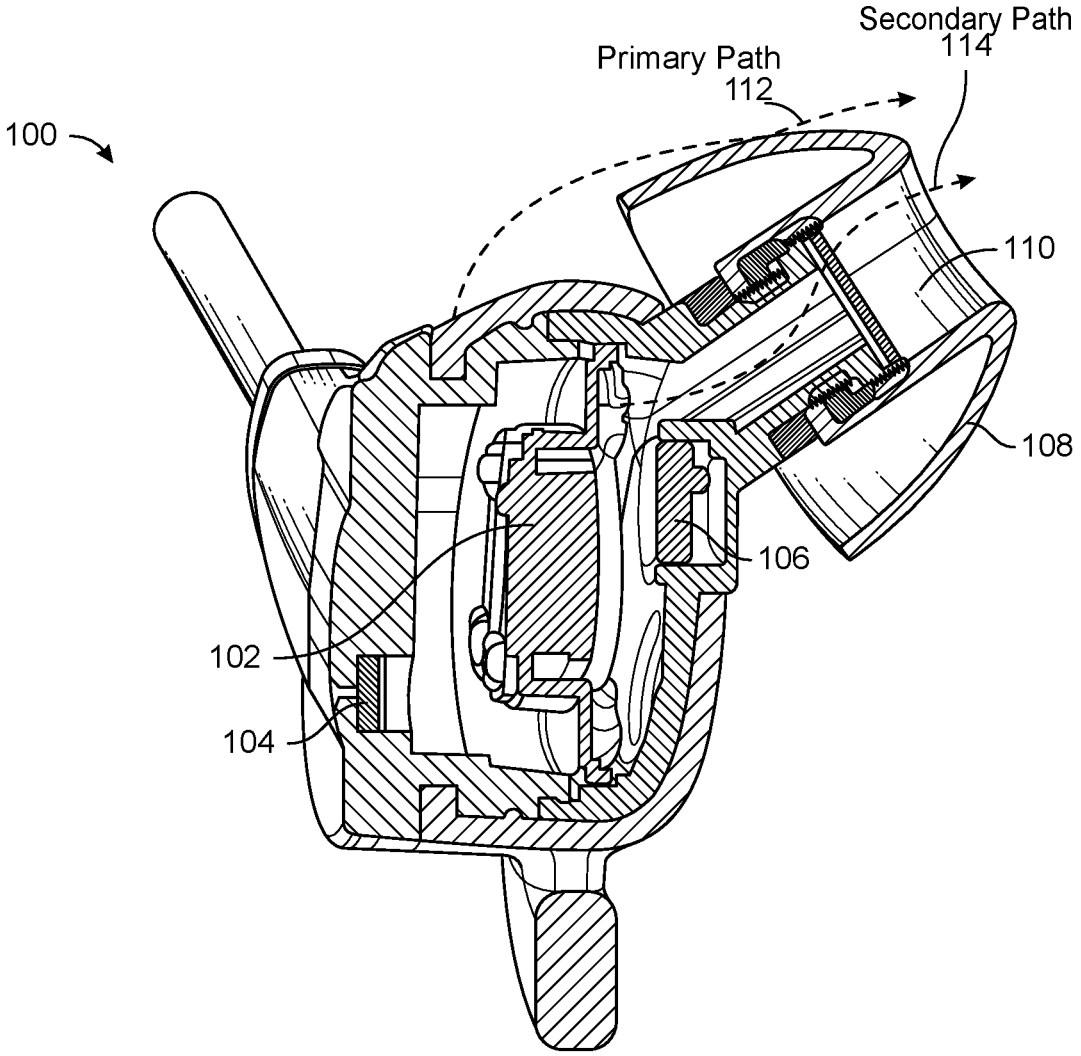
FIG. 1 is a cross-sectional drawing of an example earphone with active noise cancellation, according to an embodiment of the present disclosure.

Embodiments of the present disclosure and their advantages are best understood by referring to the detailed description that follows. Unless otherwise noted, like reference numerals denote like elements throughout the attached drawings and the written description, and thus, descriptions thereof will not be repeated. In the drawings, the relative sizes of elements, layers, and regions may be exaggerated for clarity.

DETAILED DESCRIPTION

Various embodiments of the present disclosure will be described with reference to earphones. The term "earphone" as used herein is not intended to be limited to just earphones but may be interchangeable with the terms "headphone" or "earbud" among other audio listening devices that include at least a speaker configured to be used on-ear (supra-aural), over-the-ear (circum-aural), and/or in-ear.

Basic earphones generally include one or more speakers (e.g., micro-speaker) to generate and emit (e.g., playback) sound waves. Earphones with noise cancelling features such as active noise cancellation (ANC) features include one or more speakers and one or more embedded microphones (e.g., an external microphone and an internal microphone) to capture noise to enable the noise cancellation. To achieve a quality listening experience, the speaker and microphone are designed to perform according to certain operating specifications.

To ensure quality, earphones may be calibrated by the manufacturer during production. After the earphones leave the manufacturing facility and are in the hands of a consumer, the earphones are usually not calibrated again because most users do not have the ability or capability to perform such calibration. Various parameters of the earphone may be affected (e.g., reduced sensitivity/gain, especially at the lower frequencies) as the earphones undergo wear and tear, for example, from the user putting them in his/her pocket or bag, being dropped or thrown, debris accumulation (e.g., dust, sweat, oil, moisture, etc.) on the speaker and the microphones, and/or degradation of the coupling caused by fatigue of rubber/silicone earpads and wings/tips. Over time, the wear and tear eventually shifts earphone properties such as the frequency response, total harmonic distortion, and/or uplink and downlink noise reductions, etc. Recalibration is desirable to ensure the earphones continue to produce quality audio and appropriate anti-noise for noise cancellation. In some instances, software or firmware updates to the earphones may include newly calibrated parameters but such parameters are generic across all earphones receiving the update and not necessarily specific to an individual earphone. Moreover, it may be difficult and cost prohibitive to recall used earphones back to the manufacturer for recalibration.

The embodiments of the present disclosure provide systems and methods to maintain specification parameters of the earphones through self-calibration, for example, by the consumer, without having to send the earphones back to the manufacturer and through techniques that improve performance over standardized firmware updates. According to the embodiment, a controlled environment may be provided to enclose the earphone and perform calibration, which may be repeated as often as desired and/or needed by the user. In one embodiment, the enclosure may be a storage case such as, for example, a charging case that may be used for charging the earphone batteries. Such a case can include an embedded calibration speaker, an embedded calibration microphone, and a processor to execute programmed calibration instructions, which together with a calibration processor of the earphone, can self-calibrate the earphones.

FIG. 1 is a cross-sectional drawing of an example earphone 100 with embedded active noise cancellation (ANC) features. In accordance with an embodiment, the earphone 100 is an in-ear audio device that is configured to transmit sound waves (e.g., voice or music playback) to a user's ear. The earphone 100 may have an eartip 108 that is configured to fit on or just inside the user's ear canal. The eartip 108 may be configured to substantially seal the user's ear canal to reduce ambient external noise from directly entering the user's ear canal. The earphone 100 includes a speaker 102 (e.g., micro-speaker) for emitting the sound waves that propagate through a channel 110 in the earphone and toward the user's eardrum. The earphone 100 includes an external microphone 104 that is utilized by the ANC circuitry, and is arranged such that it is exposed to noises that are external to the earphone 100 when the user wears the earphone 100. As such, the external microphone 104 is configured to pick up the external noise and the ANC circuitry of the earphone (e.g., embedded inside the earphone) generates anti-noise waves that are used to cancel at least some or a substantial amount of the detected noise that is external to the earphone 100.

An internal microphone 106 is disposed inside of the earphone and, in some embodiments, is positioned close to the speaker 102. The sound waves measured by the internal microphone 106 are used to measure the performance of the noise cancellation. While the eartip 108 is configured to substantially seal the user's ear canal, it does not form a perfect seal and some external noise may enter the ear canal by way of one or more paths, such as a primary path 112. Meanwhile, the external noise is captured by the external microphone 104 and corresponding anti-noise is generated and outputted from the speaker 102 via the second path 114. The ANC circuitry is configured to generate anti-noise to substantially cancel out the detected external noise (e.g., which may correspond to the noise that enters the user's ear canal via the primary path 112). The internal microphone 106 captures the anti-noise generated by the speaker 102, the external noise received at the internal microphone 106, and/or a playback signal generated by the speaker 102 (e.g., music or speech played through the speaker 102) and provides a feedback/error signal to the ANC circuitry for use in adjusting the anti-noise signal to improve performance. The embodiments of the present disclosure will describe techniques to calibrate an exemplary earphone like the one illustrated in FIG. 1 to optimize the speaker performance and noise cancellation quality.

Figure 2:
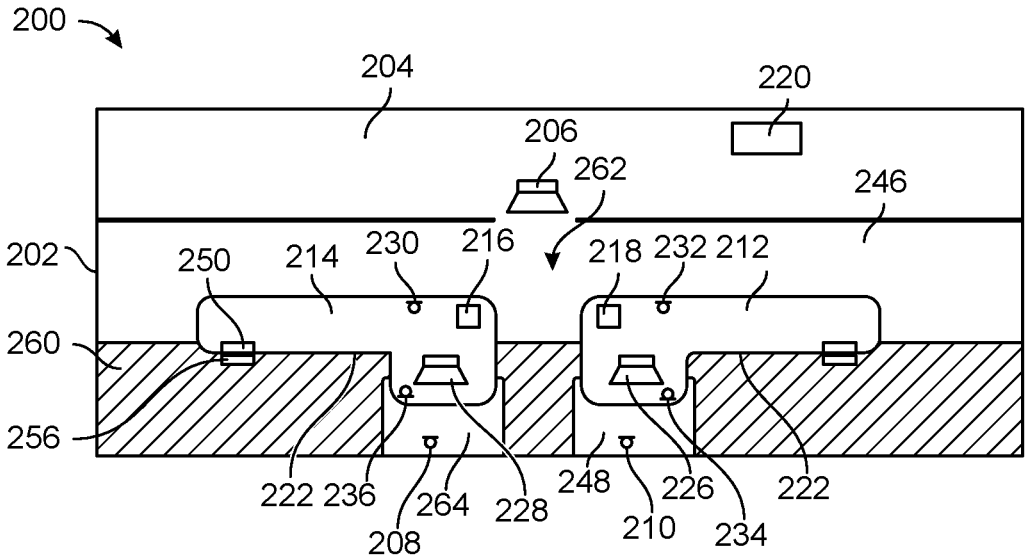
FIG. 2 is an illustration of an example self-calibration case, according to an embodiment of the present disclosure.

FIG. 2 is an illustration of an example self-calibration case 200, according to an embodiment of the present disclosure. The self-calibration case 200 ("case") is an acoustically controlled environment that accommodates the earphones 214, 212 inside to acoustically isolate the earphones 214, 212 from the external environment and perform a calibration process. The case 200 may include an acoustically sealable cover 204 to completely enclose the earphones 214, 212 inside to reduce interference during the calibration process. The cover 204 may have, for example, a gasket or other like material to form a sound dampening seal when the cover 204 is closed.

In some embodiments, the case 200 includes a housing 202 having at least one cavity 222 that is substantially contoured to the shape of the earphones 214, 212 to accommodate and hold the earphones 214, 212 in place. In some embodiments, the contour of the cavity 222 may have the form of a standard coupler 264, 248 (e.g., an industry standard coupler such as IEC 711) to simulate the earphones 214, 212 being fitted in an earphone user's ear. In this manner, earphone speakers 228, 226 are pointed to or face into the coupler. The case 200 includes an embedded case calibration circuit 220 configured to communicate wirelessly (e.g., Bluetooth, Wi-Fi, other wireless connection) with an earphone ANC/calibration circuit 216, 218 embedded within each of the earphones 214, 212 to facilitate the self-calibration process. In this manner, the earphones 214, 212 may be calibrated inside the case 200 (e.g., when placed in the case to charge the batteries between use).

To perform the self-calibration, the case includes a case calibration speaker 206, configured to emit calibration noises. The case calibration speaker 206 may be positioned on the case 200, for example, in the cover 204 facing the earphones 214, 212, such that the emitted noise is directed toward the earphone 214, 212. The earphones 214, 212 include external microphones 230, 232 and internal microphones 236, 234 that measure the calibration noises that propagate from the case calibration speaker 206 depending on the calibration process that is being performed. Thus, the case 200 enclosure contains a noise propagation space 246, 262 for the calibration noise to propagate, simulating an external noise environment for the earphones 214, 212. The external microphones 230, 232 measure the calibration noise from the case calibration speaker 206, and the internal microphones 236, 234 measure the error inside the earphone based on the calibration noise and the anti-noise generated by the ANC earphones.

In some embodiments, the case 200 may further include calibration microphones (e.g., left calibration microphone 208 and right calibration microphone 210) to measure calibration noises that are emitted by the left earphone speaker 228 and the right earphone speaker 226, respectively, simulating the earphones 214, 212 being inside a user's ear. More specifically, the earphones 214, 212 are positioned such that the earphone speakers 228, 226 face in a direction toward the left and right calibration microphones, respectively (e.g., which may be positioned to simulate the sound received at a user's left and right eardrums, respectively). Accordingly, when the earphones 214, 212 are placed in their respective slots in the case 200 and the cover 204 is closed, a calibration acoustic environment is created that simulates the earphones 214, 212 being fitted in a person's ear with a primary path and a secondary path for the calibration noises to propagate and perform the calibration procedures accordingly.

Together, the earphone ANC/calibration circuits 216, 218 and the case calibration circuit 220 coordinate to execute the calibration process, for example, by emitting a calibration noise (e.g., a tone of a certain frequency, a sweeping range of tones of various frequencies, or pink noise) from the case calibration speaker 206 while listening (and thereby measuring) the calibration noise with the earphones 214 and 212 according to a calibration process. According to another calibration process, the left earphone speaker 228 and the right earphone speaker 226 may emit the calibration noise, and the left calibration microphone 208 and the right calibration microphone 210 may listen to the calibration noise. The measured calibration information may be processed by the case calibration circuit 220 and/or the earphone ANC/calibration circuit 216, 218 to update the earphone calibration parameters (e.g., speaker calibration gain, microphone calibration gain, etc.). Accordingly, a self-calibration process may be performed on the earphones by inserting the earphones in the self-calibration case 200.

In some embodiments, the self-calibration case 200 may also include charging contacts 256 that are configured to make contact with corresponding earphone charging contacts 250 to charge the batteries of the earphones 214, 212 when they are inserted in to the cavity 222.

In some embodiments, the walls of the housing 202 and the cover 204 may be insulated with sound absorbing or sound proofing material or other techniques to further reduce sound leakage between the interior and the exterior of the self-calibration case 200. In some embodiments, the housing 202 and the cover 204 may be a hard-shell case such as a hard plastic or polymer that maintains its shape and does not deform during its intended use, even when compressed or after repeated use.

Figure 3:
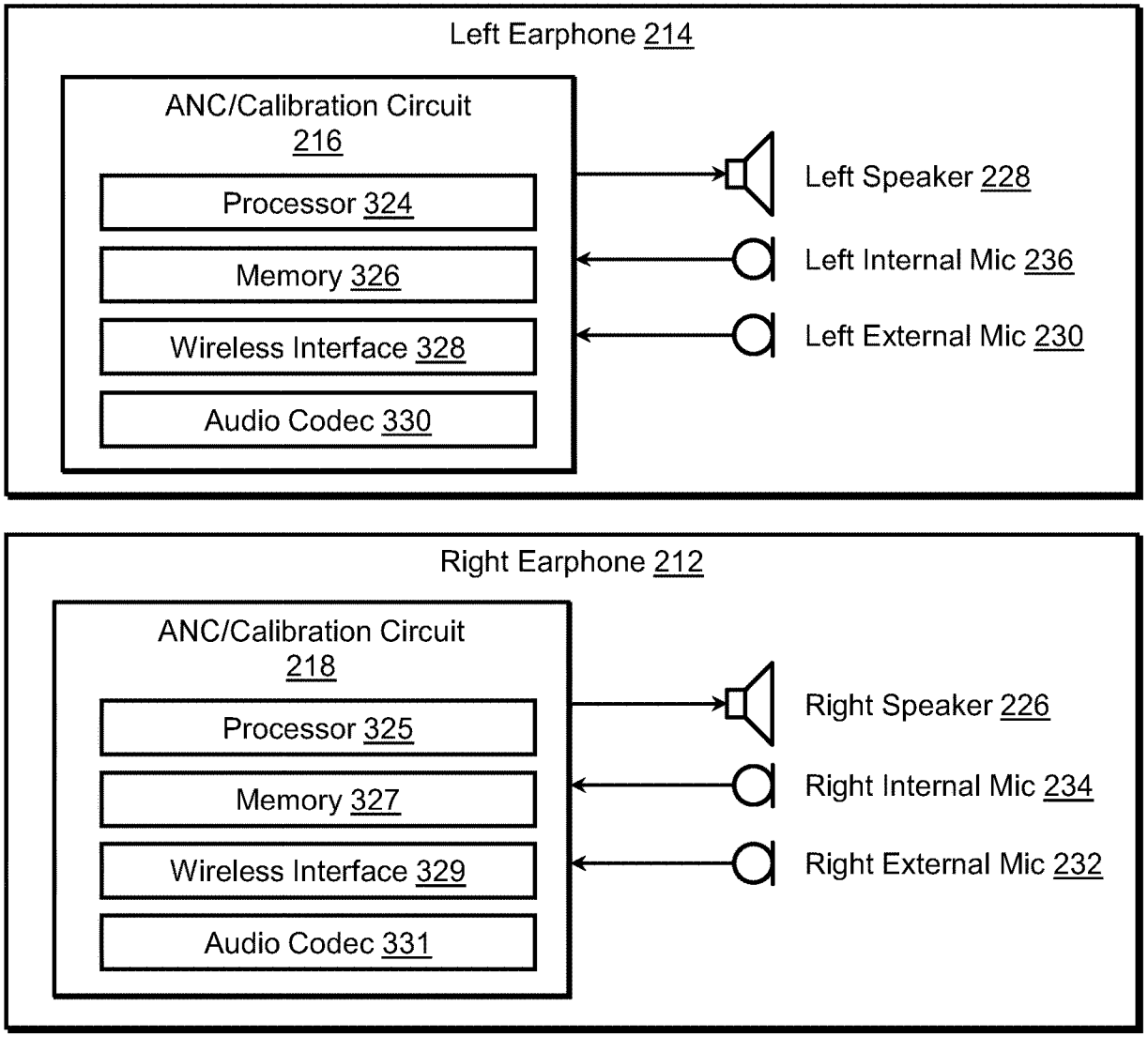
FIG. 3 is a system block diagram illustrating some features of an example earphone, according to an embodiment of the present disclosure.

FIG. 3 is a system block diagram illustrating some features of an exemplary ANC earphone, according to an embodiment of the present disclosure. The system may include a left earphone 214 that includes an embedded left speaker 228, a left internal microphone 236, a left external microphone 230, and a left earphone ANC/calibration circuit 216, and a right earphone 212 that includes an embedded right speaker 226, a right internal microphone 234, a right external microphone 232, and a right earphone ANC/calibration circuit 218. Each of the left and right earphone ANC/calibration circuits 216, 218 includes a logic device and/or circuitry configured to facilitate active noise cancellation during operation of the left and right earphones 214, 212 respectively, and facilitate calibration of the ANC system as described herein. In some embodiments, each of the left and right earphone ANC/calibration circuits 216, 218 includes at least a processor 324, 325, a memory 326, 327, a wireless interface 328, 329, and an audio codec 330, 331. In some embodiments where the ANC earphone is a wired ANC earphone, the left earphone calibration circuit 216 and right earphone ANC/calibration circuit 218 may be combined into a single circuit and embedded in just one of either the left earphone 214 or the right earphone 212. That is, the single circuit is able to control the calibration process for both the left and the right earphones via a wired connection. The following will be described for the left earphone 214 and the left earphone calibration circuit 216 but the description is also applicable with reference to the right earphone 212.

The processor 324 may comprise one or more of a processor, a microprocessor, a single-core processor, a multi-core processor, a microcontroller, a programmable logic device (PLD) (e.g., field programmable gate array (FPGA)), a digital signal processing (DSP) device, or other logic device that may be configured, by hardwiring, executing software instructions, or a combination of both, to perform various operations discussed herein for embodiments of the disclosure. The left earphone ANC/calibration circuit 216 is operable to interface and communicate with the self-calibration case 200 via the wireless interface 328 or via physical connections, such as through a contact or other electronic communications interface.

It will be appreciated that although the earphone ANC/calibration circuit 216 and the earphone 214 is shown as incorporating a combination of hardware components, circuitry, and software, in some embodiments, at least some or all of the functionalities that the hardware components and circuitries are operable to perform may be implemented as software modules being executed by the processor 324 in response to software instructions and/or configuration data, stored in the memory 326 or firmware of the earphone ANC/calibration circuit 216.

The memory 326 may be implemented as one or more memory devices operable to store an operating system and other data and information such as audio data and program instructions. Memory 326 may comprise one or more various types of memory devices including volatile and non-volatile memory devices, such as RAM (Random Access Memory), ROM (Read-Only Memory), EEPROM (Electrically-Erasable Read-Only Memory), flash memory, and/or other types of non-transitory memory.

The processor 324 may be operable to execute software instructions stored in the memory 326. Applications stored on the memory 326 may be software applications executable by the processor 324 to perform operations with or without user inputs from a user interface. In some embodiments, the application may be a calibration processing application where a user may initiate through the user interface. The user interface may be a button, or a switch located on the earphone 214, an interface integrated into the case, and/or it may be an interface on a remote device such as a smartphone, tablet, or a computer in communication with the earphone and/or the self-calibration case.

The wireless interface 328 facilitates communication between the left earphone ANC/calibration circuit 216 and the self-calibration case 200 and/or other external devices such as a smartphone, tablet or a computer. For example, the wireless interface 328 may enable Wi-Fi (e.g., 802.11) or Bluetooth connections between the self-calibration case 200 and/or other local devices, such as a smartphone, tablet, or laptop computer. In various embodiments, the wireless interface 328 may include other wired and wireless communications components facilitating direct or indirect communications between the case calibration circuit 220 and the earphone 214.

The audio codec 330 may comprise one or more of a processor, a microprocessor, a single-core processor, a multi-core processor, a microcontroller, a programmable logic device (PLD) (e.g., field programmable gate array (FPGA)), a digital signal processing (DSP) device, or other logic device that may be configured, by hardwiring, executing software instructions, or a combination of both, to process audio signals, including but not limited to converting analog audio to digital audio, or converting digital audio to analog audio. The audio codec 330 may therefore take audio data that is stored in the memory 326, convert from digital to analog and transmit that analog audio information to the speaker 228. Similarly, the audio codec 330 may take analog audio captured by the external microphone 230 or internal microphone 236 and convert the analog audio signal to digital and process, such as calibrate or store in memory 326.

Figure 4:
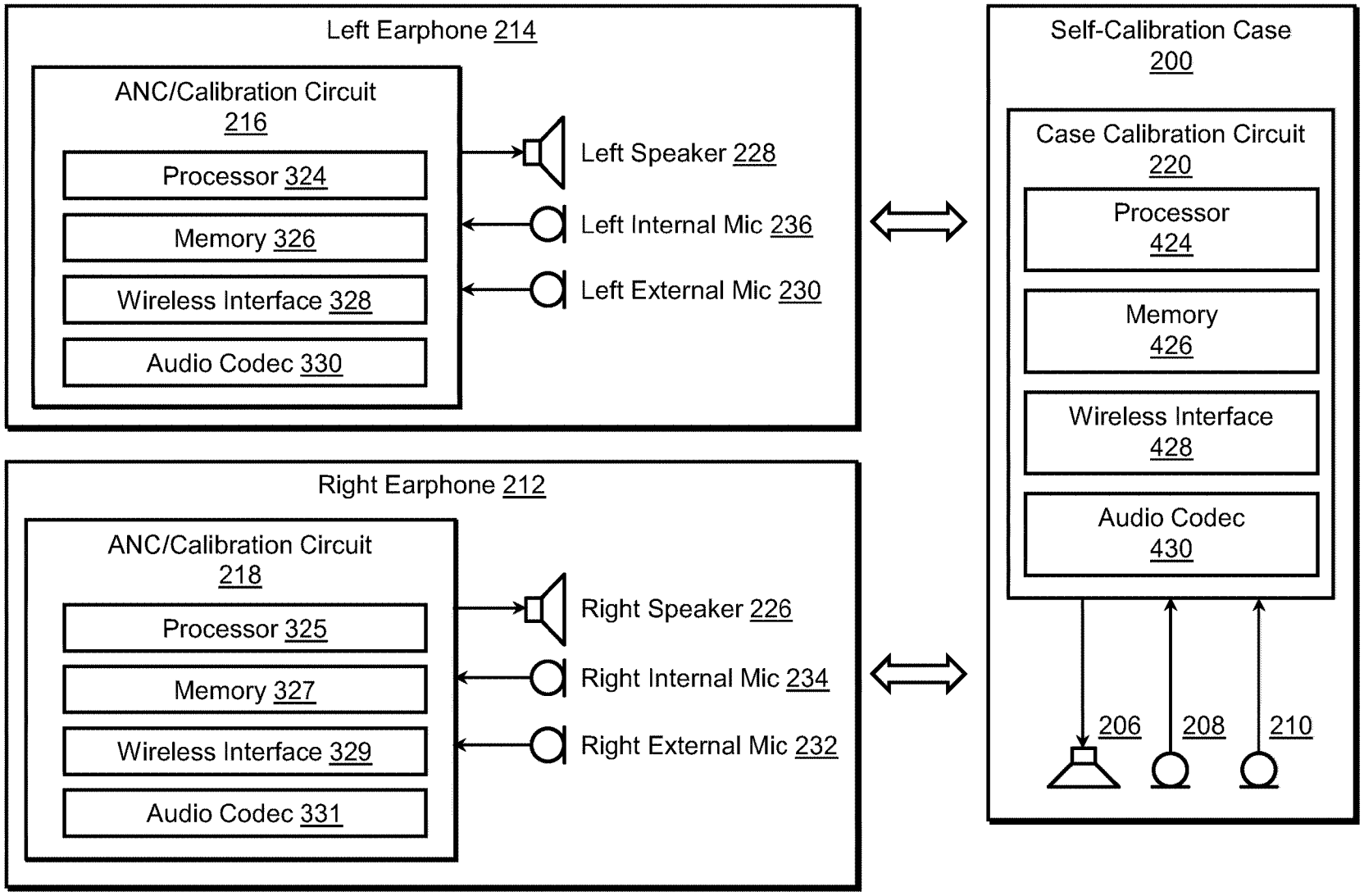
FIG. 4 is a system block diagram illustrating an example earphone and self-calibration case, according to an embodiment of the present disclosure.

FIG. 4 is a system block diagram illustrating the exemplary ANC earphone block diagram of FIG. 3 with an exemplary block diagram of the self-calibration case 200, according to an embodiment of the present disclosure. The self-calibration case 200 includes a case calibration circuit 220 that includes at least a processor 424, a memory 426, a wireless interface 428, and an audio codec 430. In some embodiments, the self-calibrating case 200 may use similar hardware components as described above with reference to the left earphone ANC/calibration circuit 216 of FIG. 3.

The processor 424 may comprise one or more of a processor, a microprocessor, a single-core processor, a multi-core processor, a microcontroller, a programmable logic device (PLD) (e.g., field programmable gate array (FPGA)), a digital signal processing (DSP) device, or other logic device that may be configured, by hardwiring, executing software instructions, or a combination of both, to perform various operations discussed herein for embodiments of the disclosure. The case calibration circuit 220 is operable to interface and communicate with the earphones 214, 212 via the wireless interface 428 or via physical connections, such as through contacts or other electronic communications interface.

It will be appreciated that although the case calibration circuit 220 is shown as incorporating a combination of hardware components, circuitry, and software, in some embodiments, at least some or all of the functionalities that the hardware components and circuitries are operable to perform may be implemented as software modules being executed by the processor 424 in response to software instructions and/or configuration data, stored in the memory 426 or firmware of the case calibration circuit 220.

The memory 426 may be implemented as one or more memory devices operable to store an operating system and other data and information such as audio data and program instructions. Memory 426 may comprise one or more various types of memory devices including volatile and non-volatile memory devices, such as RAM (Random Access Memory), ROM (Read-Only Memory), EEPROM (Electrically-Erasable Read-Only Memory), flash memory, hard disk drive, and/or other types of non-transitory memory.

The processor 424 may be operable to execute software instructions stored in the memory 426. Applications stored on the memory 426 may be software applications executable by the processor 424 to perform operations with user. In some embodiments, the application may be a calibration processing application where a user may initiate through the user interface. The user interface may be a button, or a switch disposed on the self-calibration case 200 or it may be an interface to a remote device such as a smartphone, tablet, or a computer that is wirelessly connected to the case calibration circuit 220.

The wireless interface 428 facilitates communication between the case calibration circuit 220 and the left earphone ANC/calibration circuit 216, the right earphone ANC/calibration circuit 218, and external devices such as a smartphone, tablet or a computer. For example, the wireless interface 428 may enable Wi-Fi (e.g., 802.11) or Bluetooth connections between the case calibration circuit 220 and/or other local devices, such as a smartphone, tablet, or laptop computer. In various embodiments, the wireless interface 428 may include other wired and wireless communications components facilitating direct or indirect communications between the left and right earphone ANC/calibration circuits 216, 218 and the case calibration circuit 220.

The audio codec 430 may comprise one or more of a processor, a microprocessor, a single-core processor, a multi-core processor, a microcontroller, a programmable logic device (PLD) (e.g., field programmable gate array (FPGA)), a digital signal processing (DSP) device, or other logic device that may be configured, by hardwiring, executing software instructions, or a combination of both, to process audio signals, including but not limited to converting analog audio to digital audio, or converting digital audio to analog audio. The audio codec 430 may therefore take audio data that is stored in the memory 426, convert from digital to analog and transmit that analog audio information to the case calibration speaker 206. Similarly, the audio codec 430 may take analog audio captured by the calibration microphones 208, 210, and convert the analog audio signal to digital and process, such as calibrate or store in memory 426.

FIGS. 5-8 illustrate and describe example calibration processes that may be executed and performed on the earphone 100 using the self-calibration case 200 according to various embodiments of the present disclosure. Various examples may be described with reference to just one earphone, for example, just the left earphone or just the right earphone. However, the embodiments may also be applicable to both the left and the right earphone.

Figure 5A:
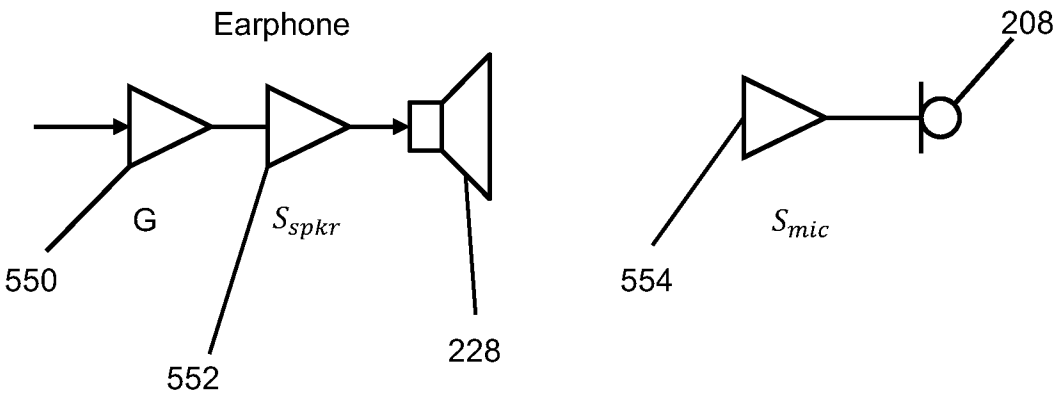
FIG. 5A is a schematic diagram of an example self-calibrating system, according to an embodiment of the present disclosure.

FIG. 5A is a schematic diagram of an example self-calibrating system according to an embodiment of the present disclosure. According to an embodiment, the sensitivities 552, 554 may be a fixed, nominal value of the speaker 228 and microphone 208, respectively, and gain 550 of the earphone speaker 228 may be set for optimal performance by the speaker calibration process. In some embodiments, the gain 550 may be a filter that is set during manufacturing, but it may also be updatable post-manufacturing by a user, according to various calibration processes described in the present disclosure. Thus, by executing the self-calibration procedure in the case 200, an updated filter value may be determined to adjust the gain 550 to improve optimal performance by the earphone speaker 228.

Figure 5B:
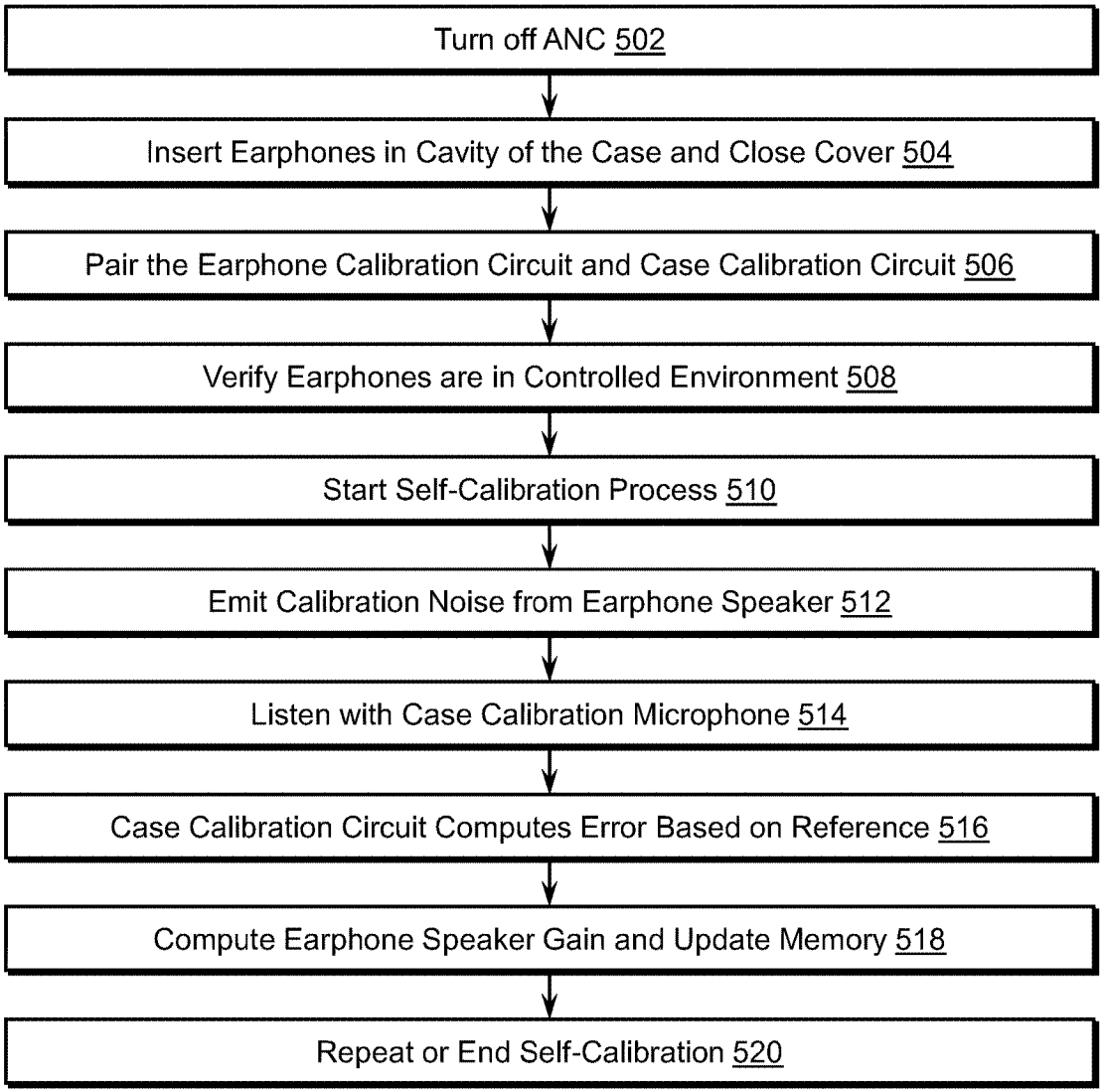
FIG. 5B is a flow chart illustrating one example of the self-calibration process, according to an embodiment of the present disclosure.

FIG. 5B is a flow chart illustrating one example of the self-calibration process, according to an embodiment of the present disclosure. In accordance with this embodiment, techniques for performing self-calibration of the earphone speaker 228 are described. First, the earphone ANC is turned off (502). Next, the earphone 214 is inserted into the cavity 222 and the cover 204 is closed, isolating the earphone 214 inside of the self-calibration case 200 (504). When the earphone 214 is inserted into the case 200, a pairing process may be executed to wirelessly connect the case calibration circuit 220 with the left earphone ANC/calibration circuit 216, e.g., a Bluetooth connection (506). In some embodiments, the left earphone ANC/calibration circuit 216 may verify that the earphone 214 is in a sufficiently controlled environment where ambient noise is quiet enough such that it does not interfere with the calibration process (508). For example, if a user attempted to run the self-calibration system inside of a loud airplane, then the ambient noise may be too loud to properly perform calibration. Thus, the calibration process will not run until the environment is quieter. In various embodiments, audio signals received from one or more of the microphones 230, 236 and 208 may be monitored to verify that the intensity of the received signal(s) is below an acceptable silence threshold for performing calibration (e.g., close to 0 decibels). After it is verified that the earphone is in an environment that is suitable for performing calibration, the user may initiate the calibration process by manually starting the calibration through a user interface on the calibration case and/or an external device (e.g., a phone, tablet, personal computer, etc.). In some embodiments, the calibration process may automatically begin after the earphone 214 is inserted in the case and the cover 204 is closed (510). For example, a calibration initiation process may initiate the calibration process after determining that each earphone is charging, and the earphone is in a sufficiently quiet environment.

In some embodiments, the calibration process is synchronized or otherwise coordinated between the left earphone 214, right earphone 212 and self-calibration case 200 through the wireless interface components 328, 329 and 428. For example, the case calibration circuit 220 may facilitate communications with the left earphone 214 and right earphone 212 to initiate a calibration process, set a calibration mode, communicate calibration results, etc. In some embodiments, the ANC/calibration circuit, via the earphone audio codec 330, causes the earphone speaker to play a calibration noise (e.g., a tone of a certain frequency, a sweeping range of various frequencies, or pink noise) (512), and the case calibration microphone 208 listens to the calibration tone (514). The case calibration circuit 220 measures the calibration tone that is captured with the case microphone 208 and computes the earphone speaker 228 response (if any) based on reference noise (516). The information may used to compute the earphone speaker 228 gain and this information may be written to memory to update the earphone speaker gain (518), thus optimizing the speaker performance. This process may be repeated if desired or the calibration process may end here (520).

Figure 6A:
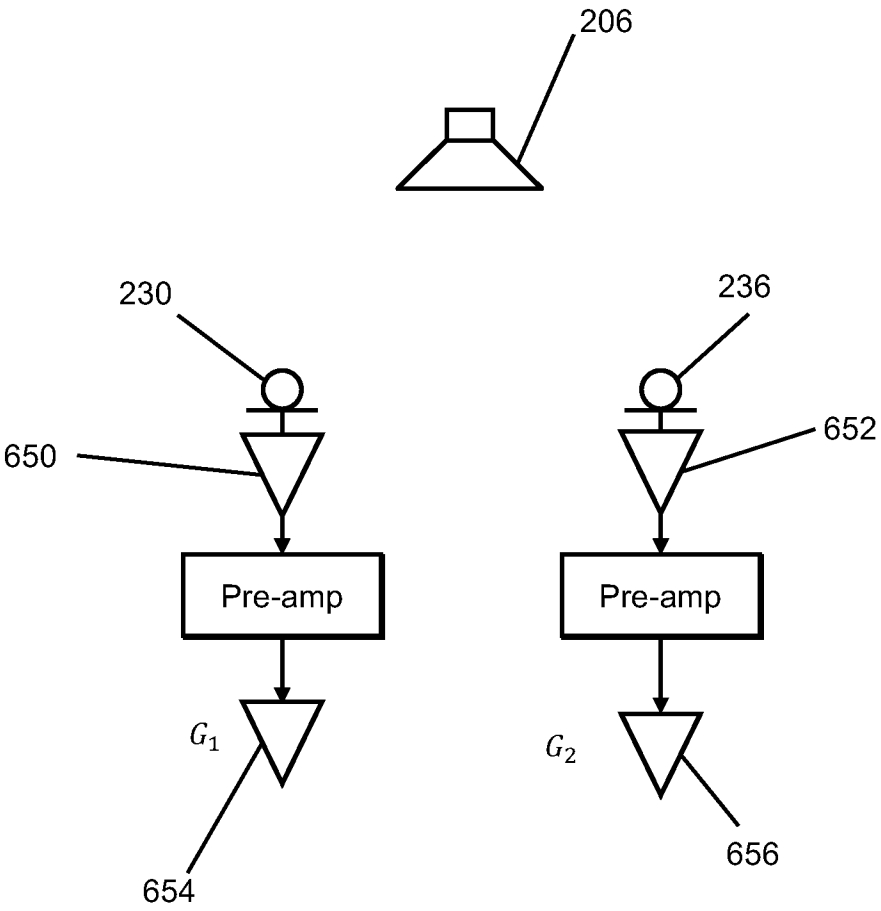
FIG. 6A is a schematic diagram of another example self-calibrating system, according to an embodiment of the present disclosure.

FIG. 6A is a schematic diagram of an example self-calibrating system according to another embodiment of the present disclosure. According to an embodiment, gain 654, 656 of the earphone external and internal microphones 230, 236 may be set for optimal performance. The sensitivities 650, 652 may be a fixed value that is set during production. In some embodiments, the gain 654, 656 may be a filter that is set during manufacturing and it may also be updatable post-manufacturing by a user, according to various calibration processes described in the present disclosure. Thus, by executing the self-calibration procedure in the case 200, an updated filter value may be determined to adjust the gain 654, 656 to achieve optimal performance by the earphone microphones.

Figure 6B:
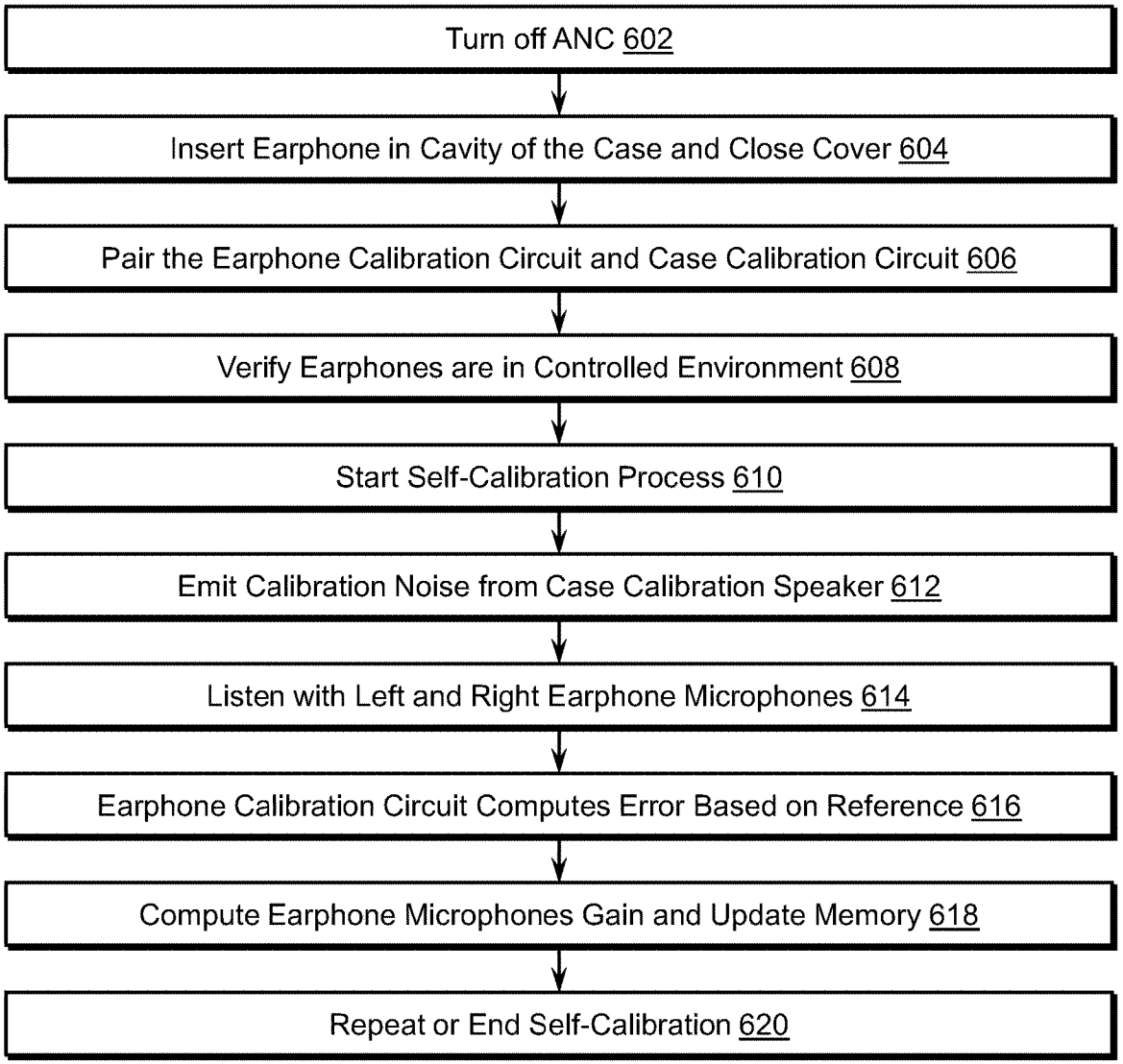
FIG. 6B is a flow chart illustrating another example of the self-calibration process, according to an embodiment of the present disclosure.

FIG. 6B is a flow chart illustrating another example of the self-calibration process, according to an embodiment of the present disclosure. In accordance with this embodiment, techniques for performing self-calibration of the earphone microphone 230 is described. In some embodiments, the self-calibration is performed on each of the left earphone external microphone 230 and the left earphone internal microphone 236. According to an embodiment, the earphone ANC is turned off (602). Next, the earphones 214, 212 are inserted in to the cavity 222 and the cover 204 is closed, isolating the earphones 214, 212 inside of the self-calibration case 200 (604). When the earphones 214, 212 are inserted into the case 200, a pairing process may be executed to wirelessly connect the case calibration circuit with the earphone ANC/calibration circuits 216, 218, e.g., a Bluetooth connection. (606). In some embodiments, the ANC/earphone calibration circuits 216, 218 may verify that the earphones 214, 212 are in a sufficiently controlled environment where ambient noise is quiet enough such that it does not interfere with the calibration process (608).

In some embodiments, the user may initiate the calibration process by manually starting the calibration through a user interface. In some embodiments, the calibration process may automatically begin the calibration process after the earphones 214, 212 are inserted in the case 200 and the cover 204 is closed (610). In some embodiments, the calibration process is synchronized or otherwise coordinated between the left earphone 214, right earphone 212 and self-calibration case 200 through the wireless interface components 328, 329 and 428. In some embodiments, the case calibration circuit 220, via case audio codec 430, causes the case calibration speaker 206 to output a calibration noise (612) (e.g., a reference tone), and the earphone microphones 230, 236 listen and measure the calibration noise (614). The earphone ANC/calibration circuits 216, 218 measure the calibration sound that is captured with the earphone microphones 230, 236 and computes the microphones' responses (if any) based on the reference tone (616). The information may be used to compute the earphone microphone gain and this information may be written to memory to update the microphone gain (618), thus improving the earphone microphone parameters to optimal operation (e.g., noise cancellation). This process may be repeated if desired and/or necessary or the calibration process may end here (620).

Figure 7A:
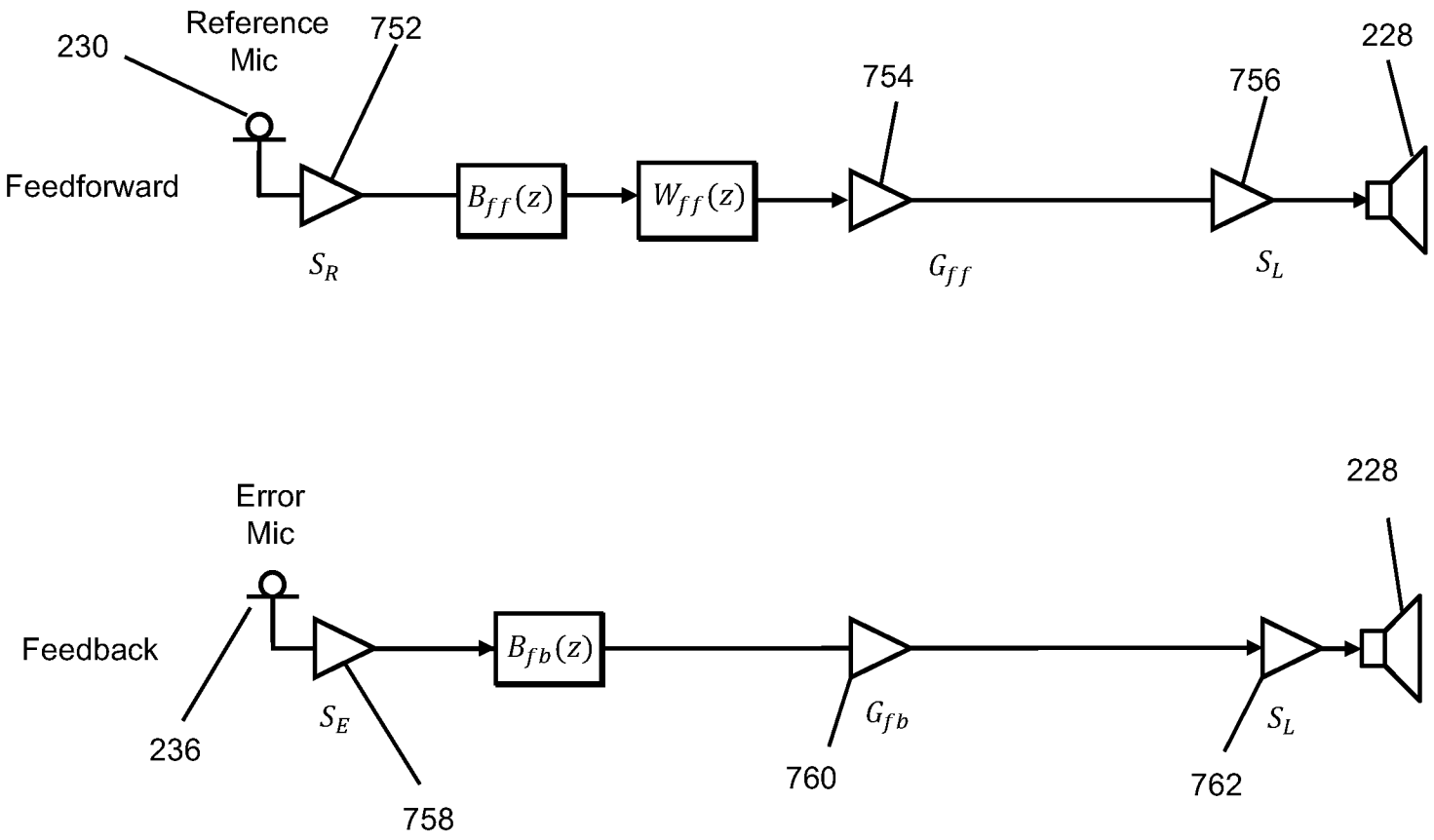
FIG. 7A is a schematic diagram of an ANC self-calibration system, according to an embodiment of the present disclosure.

FIG. 7A is a schematic diagram of an ANC system according to an embodiment of the present disclosure. In some embodiments, ANC may be performed in a feedforward mode as illustrated. In the feedforward mode, the earphone external microphone 230 is used to detect external noise and the detected noise may be processed through ANC feedforward filters $B_{ff}(z)$ and $W_{ff}(z)$ to generate anti-noise in an effort to cancel the noise level experienced by the user. The sensitivity 752, 756 of the external microphone 230 and the speaker 228 may be fixed values. In some embodiments, the calibration gain 754 of the anti-noise may also be set during manufacturing through various filters but may also be updated by the user over time by using the calibration case 200, described according to various embodiments of the present disclosure to optimize ANC performance.

In other embodiments, ANC may be performed in feedback mode as illustrated. In the feedback mode, the earphone internal microphone 236 is used to detect error noise. The error is processed through ANC feedback filter $B_{fb}(z)$ to generate anti-noise to reduce the error. The calibration gain 760 may be adjusted to more precisely reduce the error. Such gain may also be determined by performing the self-calibration process according to the embodiments of the present disclosure.

Figure 7B:
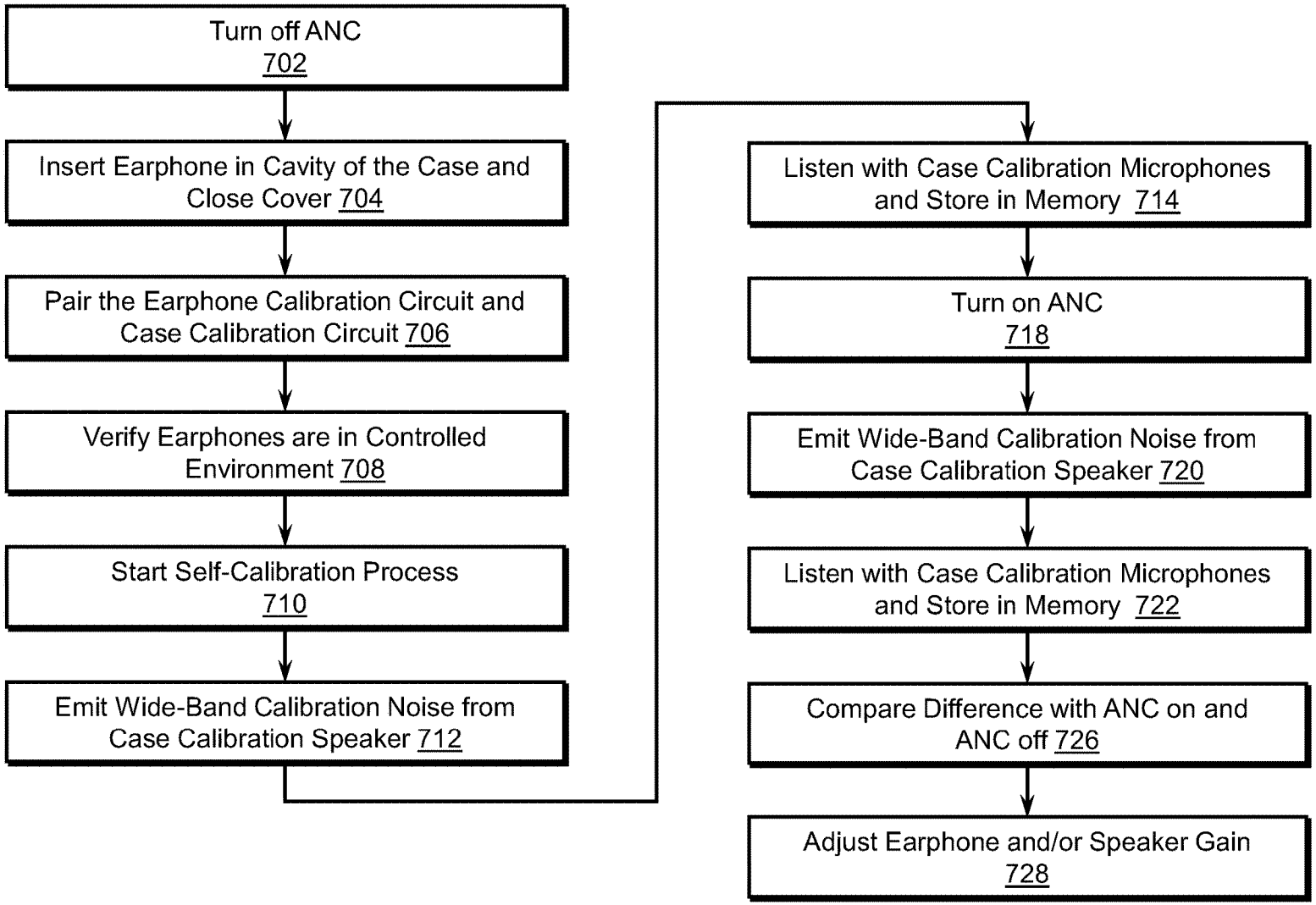
FIG. 7B is a flow chart illustrating another example of the self-calibration process, according to an embodiment of the present disclosure.

FIG. 7B is a flow chart illustrating another example of the self-calibration process, according to an embodiment of the present disclosure. Active noise cancellation relies on the performance of the earphone speakers 228 and the earphone microphones (e.g., internal microphone 236 and external microphone 230) for quality noise cancellation. Thus, calibration is performed with the ANC turned off and then performed again with the ANC turned on, and the results are compared to measure the ANC performance. According to the embodiment, the earphone ANC is initially turned off (702). Next, the earphone 214 is inserted in to the cavity 222 and the cover 204 is closed, isolating the earphone 214 inside the self-calibration case 200 (704). When the earphone 214 is inserted in to the case 200, a pairing process may be executed to wirelessly connect the case calibration circuit 220 with the earphone ANC/calibration circuit 216, e.g., a Bluetooth connection (706). In some embodiments, the earphone ANC/calibration circuit 216 may verify that the earphone 214 is in a sufficiently controlled environment where ambient noise is quiet enough that it does not interfere with the calibration process (708). The user may initiate the calibration process by manually starting the calibration through a user interface or the calibration circuit may be configured to automatically begin the calibration process after the earphone 214 is inserted in the case and the cover 204 is closed (710).

In some embodiments, the case calibration circuit 220, via the audio codec 430, causes the case speaker 206 to sweep a wide-band calibration noise (e.g., pink noise) (712), and the case calibration microphone 208 measures the frequency response and stores this information in the earphone memory 326 (714). Next, the ANC is turned on (718) and the wide-band calibration noise is swept again (720) while the case calibration microphone 208 measures the frequency response and stores this information in the earphone memory 326 (722) and compares with the calibration information that was previously stored in the memory 326 with the ANC turned off to determine the performance of the noise cancellation (726). Based on this determination, the feedforward gain 754 and feedback gain 760 may be adjusted thus improving the overall quality of ANC (728).

Figure 8A:
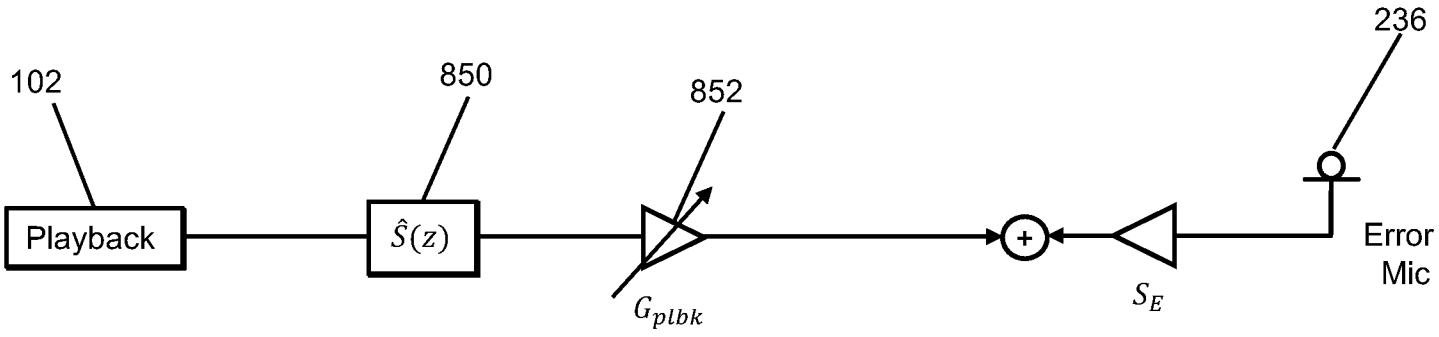
FIG. 8A is a schematic diagram of another example self-calibrating system, according to an embodiment of the present disclosure.

FIG. 8A is a schematic diagram of an ANC system according to an embodiment of the present disclosure. In some cases, a user may turn on ANC when listening to audio (e.g., music playback) in noisy environments to reduce the background noise. In this case, the earphone speaker 228 is used not only for music playback but also for generating anti-noise in the secondary path. Thus, the user can listen to the music with the background noise substantially cancelled out. The internal earphone microphone 236 is positioned on the earphone 214 near the earphone speaker 228 to measure the noise cancelled music playback to determine the error. In some embodiments, a playback cancellation calibration filter 852 may be used. In this case, the playback cancellation algorithm $\hat{S}(z)$ 850 stays on, and the earphone speaker 228 parameters is compared with the ANC turned off and with the ANC turned on. The difference is then calibrated against their desired masks and the calibration gain 852 is updated in the memory.

In some embodiments, the ANC may be kept turned off, and the earphone speaker playback 102 parameters may be compared with the playback cancellation algorithm $\hat{S}(z)$ 850 turned off and on. The difference may be calibrated against their desired masks and the calibration gain 852 is updated in the memory.

Figure 8B:
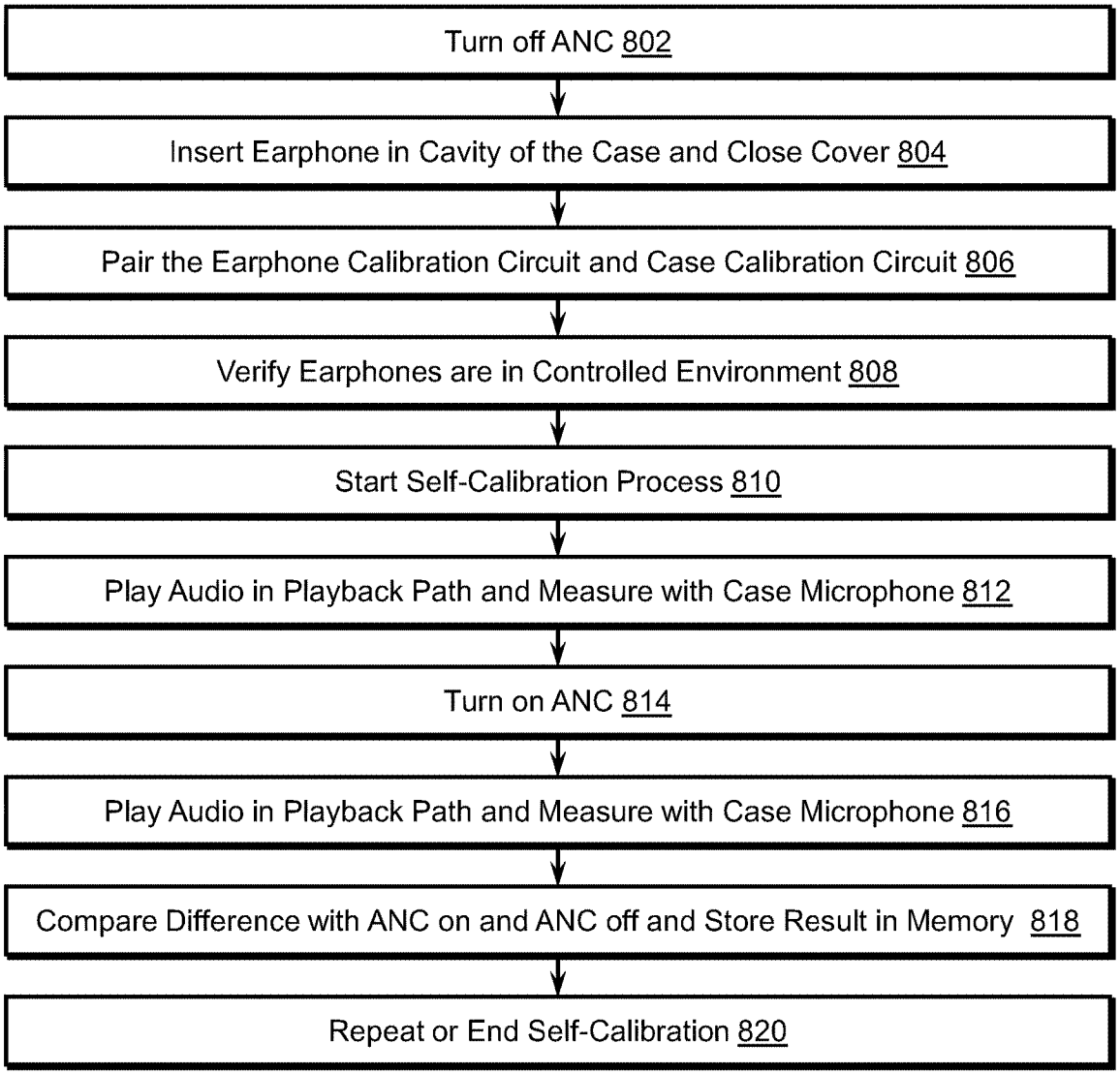
FIG. 8B is a flow chart illustrating another example of the self-calibration process, according to an embodiment of the present disclosure.

FIG. 8B is a flow chart illustrating another example of the self-calibration process, according to an embodiment of the present disclosure. Accordingly, the earphone ANC is first turned off (802). Next, the earphone 214 are inserted in to the cavity 222 and the cover 204 is closed, completely sealing the earphones 100 inside of the self-calibration case 200 (804). When the earphone 214 is inserted in to the case 200, a pairing process may be executed to wirelessly connect the case calibration circuit with the earphone calibration circuit, e.g., a Bluetooth connection. (806). In some embodiments, the left earphone ANC/calibration circuit 216 may verify that the earphone 214 is in a sufficiently controlled environment where ambient noise is quiet enough that it does not interfere with the calibration process (808). The user may initiate the calibration process by manually starting the calibration through a user interface or the calibration circuit may be configured to automatically begin the calibration process once the earphone 214 is inserted in the case and the cover 204 is closed (810). According to an embodiment of the present disclosure, the playback path is turned on for playback cancellation calibration by playing an audio, e.g., music, from the earphone speaker 228 and the playback is measured by the case microphone 208 (812). Next, the ANC is turned on (814) and the audio is played back again from the earphone speaker 228 while being measured again by the case microphone 208 (816). The difference between the measured playback with the ANC on (e.g., enabled) and off (e.g., disabled) are computed and then compared against their desired mask, and their calibration gain is stored in memory (818). This process may be repeated if necessary or the calibration process may be complete (820).

Figure 8C:
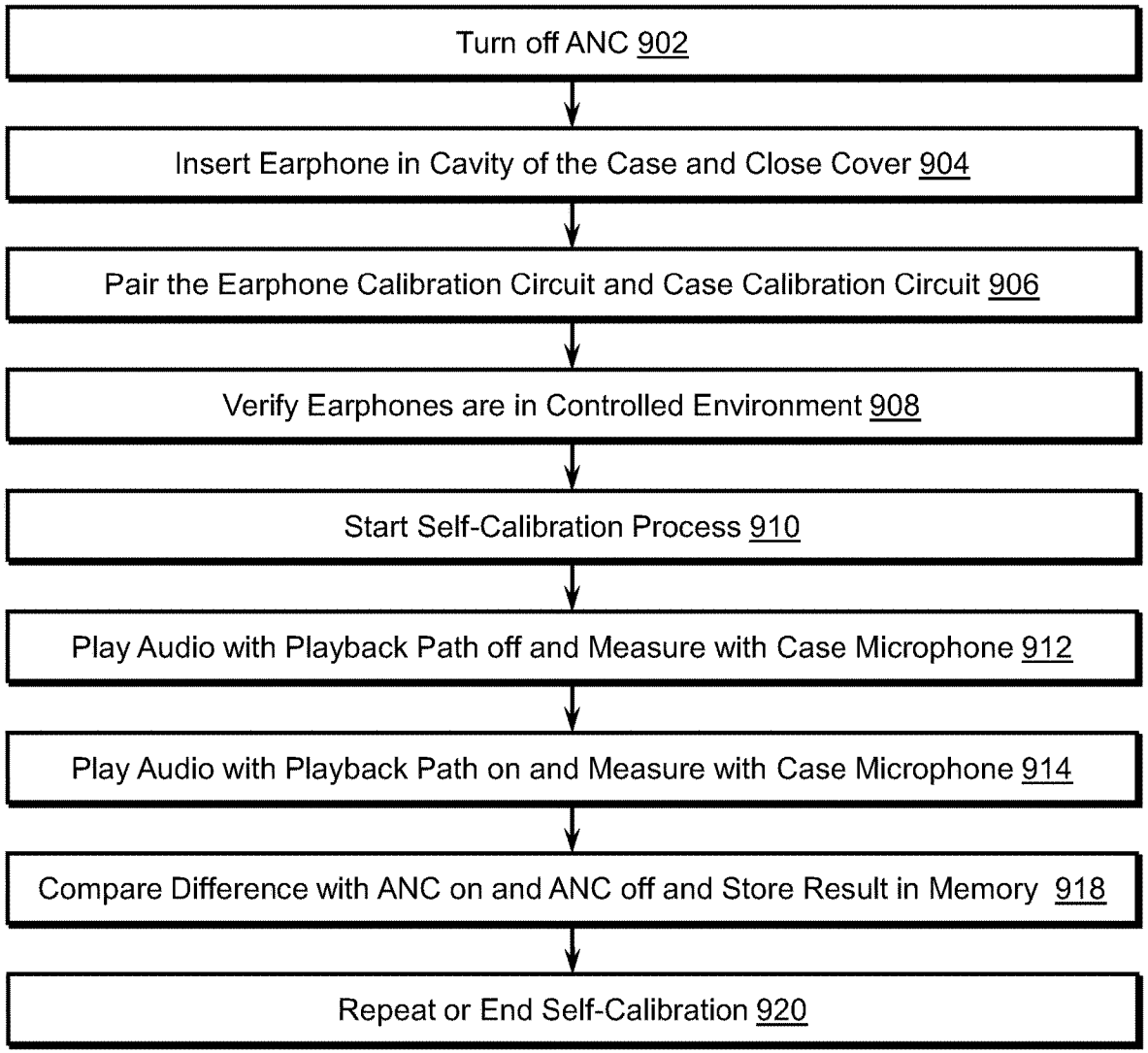
FIG. 8C is a flow chart illustrating another example of the self-calibration process, according to an embodiment of the present disclosure.

FIG. 8C is a flow chart illustrating another example of the self-calibration process, according to an embodiment of the present disclosure. Accordingly, the earphone ANC is turned off (902). Next, the earphone 214 are inserted in to the cavity 222 and the cover 204 is closed, completely sealing the earphones 100 inside of the self-calibration case 200 (904). When the earphone 214 is inserted in to the case 200, a pairing process may be executed to wirelessly connect the case calibration circuit with the earphone calibration circuit, e.g., a Bluetooth connection. (906). In some embodiments, the left earphone ANC/calibration circuit 216 may verify that the earphone 214 is in a sufficiently controlled environment where ambient noise is quiet enough that it does not interfere with the calibration process (908). The user may initiate the calibration process by manually starting the calibration through a user interface or the calibration circuit may be configured to automatically begin the calibration process once the earphone 214 is inserted in the case and the cover 204 is closed (910). According to an embodiment of the present disclosure, the playback cancellation path is turned off by playing an audio, e.g., music, from the earphone speaker 228 and the playback is measured by the case microphone 208 (912). Next, the ANC remains off and the playback cancellation path is turned on by playing an audio, e.g., music, from the earphone speaker 228 and the playback is measured by the case microphone 208 (914). The difference between the measured playback with the playback path off and on are computed and then compared against their desired mask, and their calibration gain is stored in memory (918). This process may be repeated if necessary or the calibration process may be complete (920).

In this manner, earphones may be calibrated and recalibrated by a consumer at home or wherever they choose for the life of the earphones to assure quality audio playback and quality noise cancellation, thereby extending the overall life of the earphones. The above described calibration processes are provided only as examples of calibrations and it not intended to be limited to just the described calibrations. Instead, other audio calibrations using the described calibration case 200 may be envisaged.

The systems and methods of the present disclosure may be embodied in various forms and should not be construed as being limited to only the illustrated embodiments. Rather, these embodiments are provided as examples to convey the aspects and features of the present disclosure to those skilled in the art. Accordingly, processes, elements, and techniques that are not necessary to those having ordinary skill in the art for a complete understanding of the aspects and features of the present disclosure may not be described.

The terminology used herein is for the purpose of describing particular embodiments and is not intended to be limiting of the present disclosure. It will be understood that when an element is referred to as being "on," "connected to," or "coupled to" another element, it can be directly on, connected to, or coupled to the other element, or one or more intervening elements may be present. In addition, it will also be understood that when an element is referred to as being "between" two elements, it can be the only element or layer between the two elements or layers, or one or more intervening elements or layers may also be present.

As used herein, the terms "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present disclosure refers to "one or more embodiments of the present disclosure." As used herein, the terms "use," "using," and "used" may be considered synonymous with the terms "utilize," "utilizing," and "utilized," respectively.

The electronic or electric devices and/or any other relevant devices or components according to embodiments of the present disclosure described herein may be implemented utilizing any suitable hardware, firmware (e.g. an application-specific integrated circuit), software, or a combination of software, firmware, and/or hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random-access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the example embodiments.

Embodiments described herein are exemplary only. One skilled in the art may recognize various alternative embodiments from those specifically disclosed. Those alternative embodiments are also intended to be within the scope of this disclosure. As such, the embodiments are limited only by the following claims and their equivalents.

The invention claimed is:

1. A system comprising:

a housing comprising a first calibration circuit configured to coordinate with a second calibration circuit to execute a calibration sequence for an active noise cancelling (ANC) earphone, the housing further comprising:

a cavity configured to accommodate the ANC earphone, wherein the cavity is contoured to simulate the ANC earphone in a user's ear;

a calibration microphone coupled with the first calibration circuit and configured to measure calibration sound waves from the ANC earphone; and a calibration speaker configured to emit calibration sound waves to the ANC earphone.

2. The system of claim 1, further comprising a cover configured to enclose the ANC earphone in the housing to acoustically seal the ANC earphone inside the housing, wherein the inside of the housing is an acoustically controlled environment to reduce external noise from entering inside the housing and interfere with the calibration sequence.

3. The system of claim 1, wherein system further comprises the ANC earphone accommodated in the housing, wherein the ANC earphone comprises:

the second calibration circuit embedded within the ANC earphone configured to execute the calibration sequence for the ANC earphone;

an earphone speaker configured to be calibrated during an earphone speaker calibration sequence processed by the second calibration circuit;

an earphone external microphone configured to be calibrated during an earphone external microphone calibration sequence processed by the second calibration circuit; and an earphone internal microphone configured to be calibrated during an earphone internal microphone calibration sequence processed by the second calibration circuit.

4. The system of claim 3, wherein during the earphone speaker calibration sequence, the calibration sound waves are emitted from the earphone speaker and the emitted calibration sound waves are captured by the calibration microphone.

5. The system of claim 4, wherein parameters of the earphone speaker are updated based on the captured calibration sound waves with reference to the emitted calibration sound waves.

6. The system of claim 3, wherein the ANC earphone is positioned in the cavity of the housing such that the earphone speaker faces toward the calibration microphone to provide an enclosed propagation path for the calibration sound waves from the earphone speaker to the calibration microphone.

7. The system of claim 3, wherein the ANC earphone is positioned in the cavity of the housing such that the calibration speaker faces toward the earphone external microphone to provide an enclosed propagation path for the calibration sound waves from the calibration speaker to the earphone external microphone.

8. The system of claim 3, wherein during the earphone external microphone calibration sequence, the calibration sound waves are emitted from the calibration speaker and the emitted calibration sound waves are captured by the earphone external microphone.

9. The system of claim 8, wherein parameters of the earphone external microphone are updated based on the captured calibration sound waves with reference to the emitted calibration sound waves.

10. The system of claim 1, wherein the housing comprises a coupler configured to be coupled with the ANC earphone to simulate the ANC earphone being fitted in the user's ear.

11. The system of claim 1, wherein the first calibration circuit is configured to coordinate with the second calibration circuit of the earphone by a wireless connection.

12. The system of claim 1, wherein the housing further comprises a battery charger comprising charging contacts configured be coupled with charging contacts on the ANC earphone to charge batteries of the ANC earphone.

13. The system of claim 1, wherein the first calibration circuit comprises:

a wireless interface configured to communicate with the second calibration circuit; and an audio codec configured to generate the calibration sound waves, the calibration sound waves configured to be emitted by the calibration speaker.

14. The system of claim 1, wherein the ANC earphone is an in-ear ANC earphone, an on-ear ANC earphone, or an over-the-ear ANC earphone.

15. A method for calibrating an active noise cancelling (ANC) earphone, comprising:

pairing a second calibration circuit of the ANC earphone with a first calibration circuit of a housing; and executing, by the second calibration circuit in communication with the first calibration circuit, a calibration sequence on the ANC earphone, wherein the housing comprises:

the first calibration circuit configured to coordinate with the second calibration circuit to execute a calibration sequence;

a calibration microphone coupled with the first calibration circuit and configured to capture calibration sound waves from the ANC earphone; and a calibration speaker configured to emit calibration sound waves to the ANC earphone.

16. The method of claim 15, wherein the calibration sequence comprises:

calibrating a feedforward ANC path of the ANC earphone during a feedforward ANC calibration sequence; and calibrating a feedback ANC path of the ANC earphone during a feedback ANC calibration sequence.

17. The method of claim 16, wherein the calibration sequence further comprises:

emitting, by the calibration speaker, a calibration sound wave with the ANC enabled during the calibration sequence; and capturing, by the calibration microphone, the emitted calibration sound waves.

18. The method of claim 17, wherein the calibration sequence further comprises:

updating a gain of a feedforward path and/or a gain of a feedback path based on the captured calibration sound waves with reference to the emitted calibration sound waves.

19. The method of claim 15, wherein the calibration sequence comprises:

calibrating a playback cancellation path of the ANC earphone with the ANC enabled and the ANC disabled during a playback cancellation calibration sequence.

20. The method of claim 15, wherein the housing further comprises:

a cavity configured to accommodate the ANC earphone, wherein the cavity is contoured to simulate the ANC earphone in a user's ear; and a cover configured to enclose the ANC earphone in the housing to acoustically seal the ANC earphone inside the housing, wherein the inside of the housing is an acoustically controlled environment to reduce external noise from entering inside the housing and interfere with the calibration sequence.

* * * * *